United States Patent [19]

Pohto et al.

[11] 4,244,802

[45] Jan. 13, 1981

[54] MONOPOLAR MEMBRANE CELL HAVING METAL LAMINATE CELL BODY

[75] Inventors: Gerald R. Pohto; Richard O. Olson, both of Mentor, Ohio

[73] Assignee: Diamond Shamrock Corporation, Dallas, Tex.

[21] Appl. No.: 47,298

[22] Filed: Jun. 11, 1979

[51] Int. Cl.[3] ..... C25B 9/00; C25B 11/03

[52] U.S. Cl. ..... 204/252; 204/263; 204/288

[58] Field of Search ..... 204/252, 253-258, 204/263-266, 290 F, 290 R, 267-270, 288

[56] References Cited

U.S. PATENT DOCUMENTS

| | | | |
|---|---|---|---|
| 1,327,094 | 1/1920 | Griffin | 204/256 |
| 3,719,578 | 3/1973 | Berthoux et al. | 204/252 |
| 4,037,023 | 7/1977 | Grehier et al. | 429/12 |
| 4,056,458 | 11/1977 | Pohto et al. | 204/257 X |
| 4,108,752 | 8/1978 | Pohto et al. | 204/268 X |

*Primary Examiner*—Howard S. Williams
*Assistant Examiner*—D. R. Valentine
*Attorney, Agent, or Firm*—John P. Hazzard

[57] ABSTRACT

Disclosed is a monopolar membrane cell in which identical anode and cathode pans are stamped from bimetallic laminate material in which an electrolyte resistant material is utilized on the inside of the electrolytic cell and a highly conductive metal is utilized on the outside thereof. This design results in a substantial lowering of the voltage drop due to resistance through the anode and cathode pans of membrane cells.

1 Claim, 3 Drawing Figures

MONOPOLAR MEMBRANE CELL HAVING METAL LAMINATE CELL BODY

This invention relates to the art of electrolysis cells and, more particularly, to a unitary monopolar membrane-type cell having an anode and a cathode disposed on opposite sides of the membrane and the anode and cathode each being attached to an anode and cathode pan, respectively. The anode and cathode pans enclose the anode and cathode compartments in which the electrodes are located and are formed of a bimetallic laminate material in which the inside of each of the pans is resistant to the anolyte or catholyte contained therewithin, and the outer portions of the pans are of a common, highly conductive metal.

BACKGROUND OF THE INVENTION

Many important basic chemicals which are utilized in modern society are produced by electrolysis. Nearly all of the chlorine and caustic used in the world today is produced by the electrolysis of aqueous sodium chloride solutions. There is increasing interest in the electrolysis of water for the production of oxygen and, particularly, hydrogen which is finding ever increasing use in our society. Other uses of electrolysis include electroorganic synthesis, batteries and the like and even more common applications such as water purification systems and swimming pool chlorinators.

The so-called flowing mercury cathode cells and diaphragm cells have provided the bulk of the electrolytic production of chlorine and caustic. In more recent times, the membrane-type electrolytic cell has gained popularity because of its ease of operation and, particularly, its lack of polluting effluents such as mercury or the use of carcinogenic material such as asbestos. Membrane-type electrolytic cells generally comprise an anode chamber and a cathode chamber which are defined on their common side by an hydraulically impermeable ion exchange membrane, several types of which are now commercially available but are generally fluorinated polymeric materials which have surface modifications necessary to perform the ion exchange function.

Membrane-type electrolysis cells generally comprise one of two distinct types, that is, the monopolar-type in which the electrodes of each cell are directly connected to a source of power supply, or the bipolar-type in which adjoining cells in a cell bank have a common electrode assembly therebetween which electrode assembly is cathodic on one side and anodic on the other.

Several designs of both monopolar and bipolar membrane cells incorporate a pair of formed metal pan structures which define the anode and cathode compartments when similar pans are assembled in a facing relationship with a membrane interposed therebetween. Cells of this type are described in U.S. Pat. Nos. 4,017,375 and 4,108,752.

Because of the rigorous corrosive conditions existing in the electrolytes of both anode and cathode chambers, it has been necessary to form the cathode and anode pan out of material which is resistant to the electrolyte. In most cases, anode pans were formed from titanium or other valve metal or their alloys in sheet form. Similarly, cathode pans were formed from ferrous metals such as steel, stainless steel and the like. Neither of these materials would be termed good or excellent conductors of electricity and, thus, cell voltages which are high enough to overcome the ohmic resistance of such pans, particularly with respect to titanium, are not as good as a cell which could utilize good electrical conductors such as copper or aluminum in at least a portion of their structure.

A bimetallic iron/titanium separator wall for cathode and anode sides of a bipolar electrode is described in U.S. Pat. No. 4,111,779, Seko et al. While some economies of structure are realized, this design employs metals which are not highly conductive and ohmic losses through the structure are relatively high. Further, atomic hydrogen formed at the cathode can migrate through the iron to the titanium and cause embrittlement and eventual failure thereof.

Further, pans designed in accordance with the teachings of the prior art, such as the above-mentioned U.S. Patents, employ conductor bars which are attached to the rear of the interior of the pan surfaces and which extend toward the separator and upon which the anode and cathode screens are attached. The ohmic resistance loses from these additional electrolyte-resistant materials are apparent.

The utilization of titanium and steel for anolyte and catholyte chambers results in a relatively heavy structure which requires both a substantial support structure in the assembly of these components and heavyweight handling equipment for moving such components when disassembly and assembly become necessary.

It is therefore a principal object of this invention to reduce the ohmic loss in membrane cell structures by forming such structure from a material which is both resistant to the electrolyte where it is in contact therewith and offers lower overall electrical resistance to the flow of current than materials used previously.

It is a further object of this invention to utilize a structure for membrane cells which is both light in weight and conserving of materials utilized in its assembly.

These and other objects of the invention will become apparent to those skilled in the art upon the reading and understanding of this specification.

SUMMARY OF THE INVENTION

In accordance with the invention, a monopolar membrane cell incorporating an anode disposed in an anode chamber, a cathode disposed in a cathode chamber and an hydraulically impermeable ion exchange membrane has its respective anode and cathode chambers defined by a formed metal pan having an electrolyte resistant metal forming the interior surface thereof and a relatively highly conductive metal forming the exterior surface thereof characterized in that the electrolyte resistant metal and the highly conductive metal for both the anode and the cathode pans are a laminate material.

Further in accordance with the invention, the anode pan as previously described is constructed of a metal laminate having a valve metal or alloy thereof disposed on its inner surface and the highly conductive metal which is laminated thereto such as aluminum or copper or alloys thereof.

Further in accordance with the invention, the cathode pan as previously described is constructed of a laminated material having an inner surface which is formed of a thin sheet of iron, steel, stainless steel and the like which is laminated to the outer surface comprising a relatively thick layer of a highly conductive metal such as aluminum or copper.

Still further in accordance with the invention, the anode and cathode pans as previously described are stamped on a common die and incorporate inwardly projecting indentations which act as both mounting points for the respective anodes and cathodes and serve to rigidize the pan structure.

Roll formed or explosion bonded metal laminates have long been known in the cookware industry for offering such properties as tarnish resistance in one portion of the laminate and good heat conductivity in another portion of the laminate. Thus, pots and pans having an interior surface of tarnish resistant metal such as stainless steel and an exterior surface of aluminum alloy or copper have been available. In addition to good heat conductivity which is desirable in the cookingware utensil art, aluminum and copper offer good electrical conductivity which is advantageous in arts employing electrical components. The hardness and tarnish resistance of stainless steel which is advantageous in the cookingware industry is also advantageous in electrolysis processes. Such laminates are also available with an inner layer of titanium or other valve metals which are resistant to corrosive anolyte conditions such as exist in a chloralkali electrolysis cell. Similarly, steel and stainless steel are resistant to the corrosive activity of catholytes often containing high concentrations of alkali metal hydroxides as in alkali halide electrolysis cells. Laminates may comprise a plurality of layers of differing metals as required by its application to use.

The formability of sheet laminate material has been demonstrated with the availability of cooking utensils such as pots and pans of relatively complicated structure. It has now been found that such bimetallic laminates may be advantageously used as structural material for cells used in the art of electrolysis offering the advantage of low weight, high electrical conductivity and electrolyte resistance. Furthermore, through the utilization of common dies to stamp both anolyte and catholyte pans, the inventory for the manufacture of complete electrolysis cells may be substantially reduced.

Monopolar cells assembled in a manner in accordance with the invention offer the advantages of easy removal from a bank of cells for repair or replacement without interupting the operation of adjacent cells since it is both the conductor and the containment vessel. Furthermore, the unitary monopolar cells are identical and may be interchanged readily within the system. This is also advantageous in that the production capacity can be easily adjusted to the needs of the location employed by merely multiplying the number of cells needed for a given amount of product. Thus, on site generation of chlorine and caustic such as in a paper mill or other similar facility is easily met.

BRIEF DESCRIPTION OF THE INVENTION

The invention will now be further discussed through a description and reference to the appended drawings forming a part of this specification and, in which.

DETAILED DESCRIPTION OF THE PREFERRED EMBODIMENTS AND DRAWINGS

Figure 1:
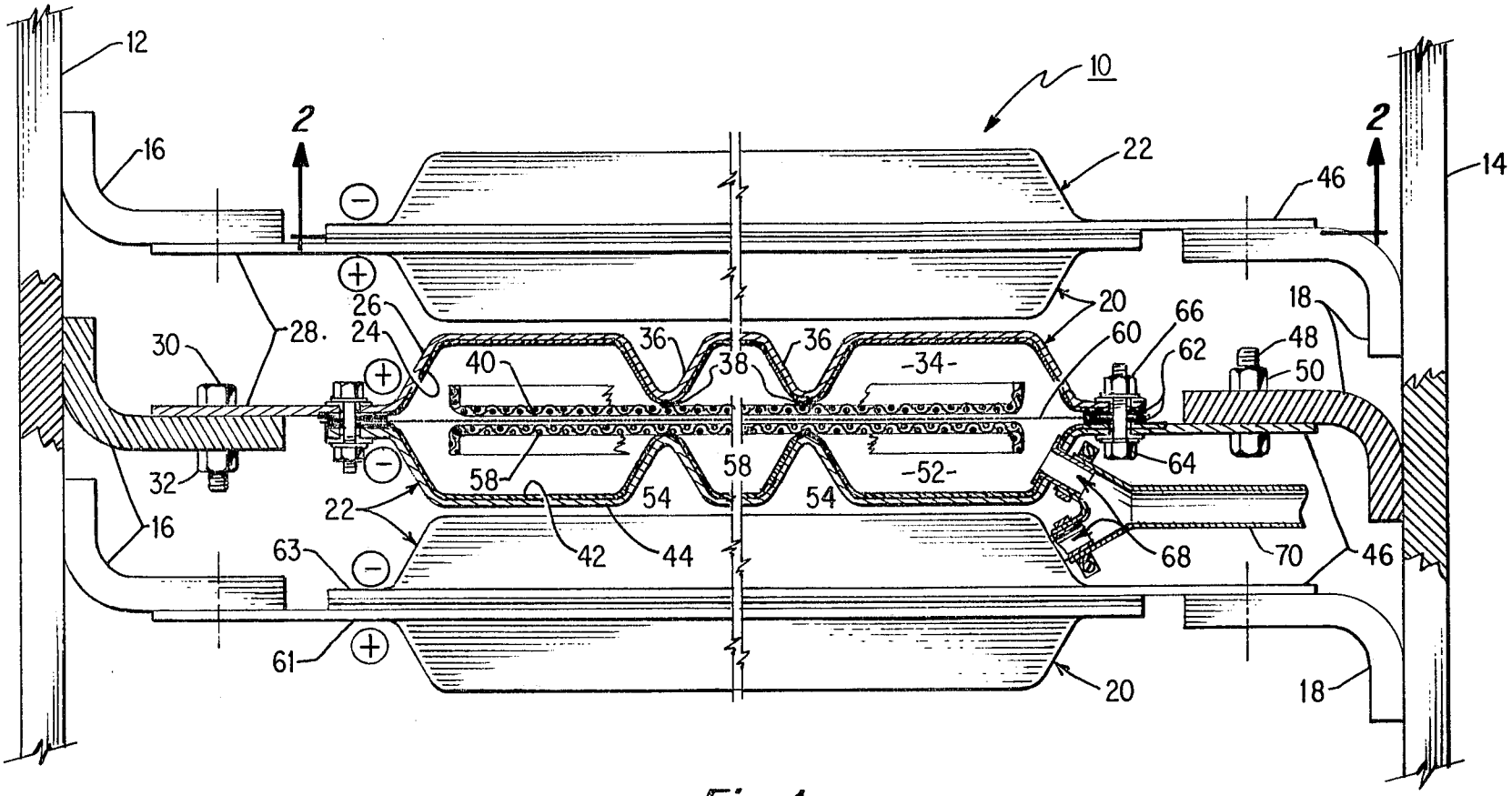
FIG. 1 is a plan view in partial section showing the installation of a plurality of cells made in accordance with the invention.
Figure 2:
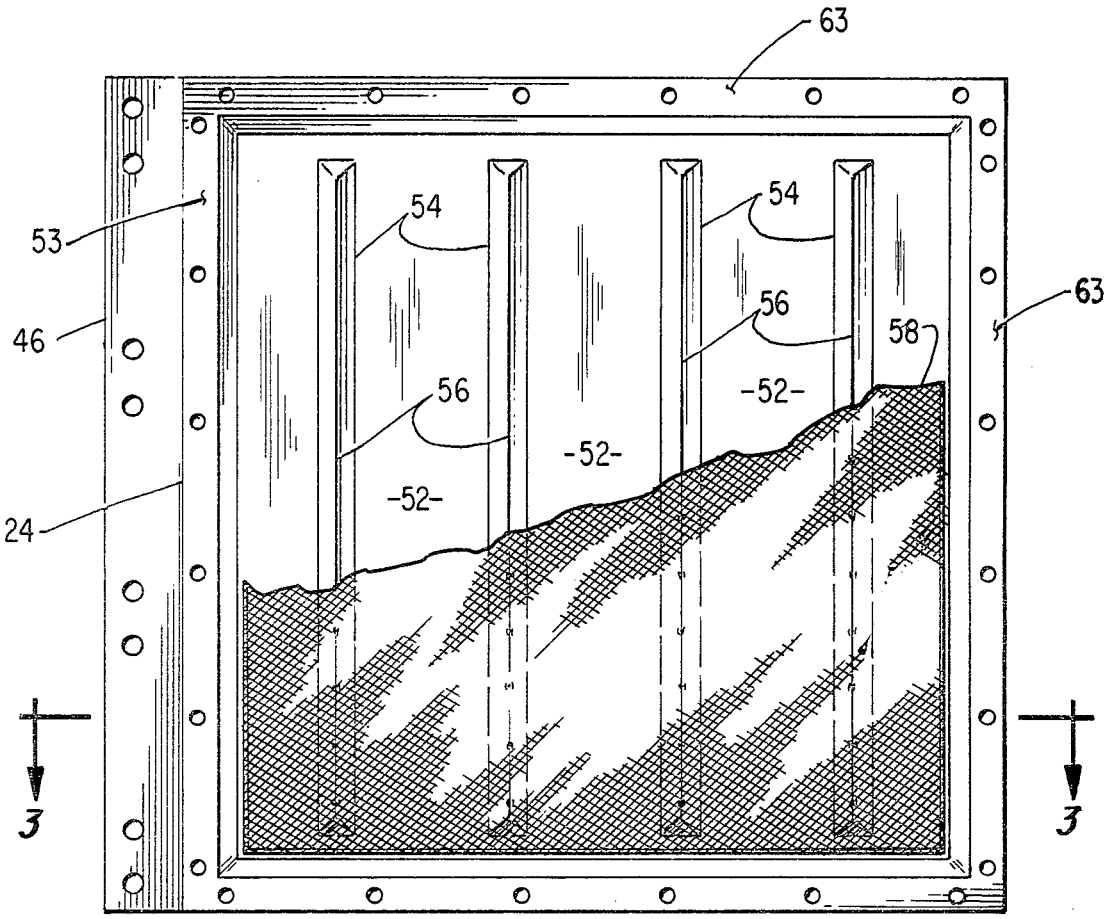
FIG. 2 is a side elevational view of a portion of the cell bank shown in FIG. 1 taken along lines 2—2 thereof.
Figure 3:
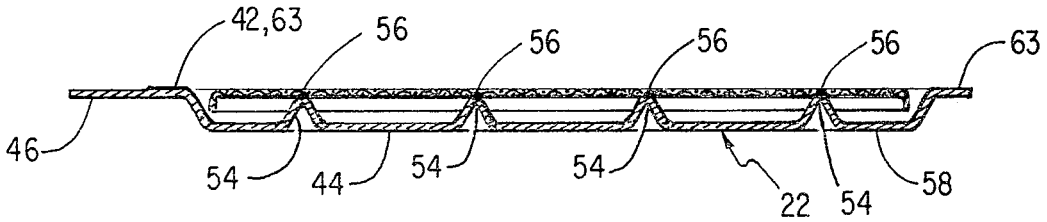
FIG. 3 is a cross-sectional view taken along lines 3—3 of FIG. 2.

Referring now to the drawing wherein the showings are for the purpose of illustrating a preferred embodiment of the invention and not intended to constitute any limitation on the invention itself, FIG. 1 shows a plurality of monopolar cells 10 connected to anode bus bar 12 and cathode bus bar 14 through connectors 16 and 18, respectively. Monopolar cells 10 each comprise an anode pan 20 and a cathode pan 22.

Anode pan 20 is formed of a bimetallic laminated material having an inner layer 24 which is a valve metal or alloy thereof and, preferably, titanium. Outer layer 26 of anode pan 20 is laminated to inner layer 24 and is, preferably, made of a highly conductive metal such as aluminum or copper. Outer layer 26 extends beyond the pan structure itself to provide tab portion 28 which may be connected directly to anode connector 16 by fastening means such as bolt 30 and nut 32. Anode bus bar 12 and anode connector 16 would normally be fabricated from copper bar stock. If outer layer 26 of anode pan 20 is of a copper material, there would be no problem whatsoever with attaching tab portion 28 directly to anode connector 16. If, however, outer layer 26 of anode pan 20 is formed of aluminum, the connection at anode connector 16 could pose a problem with bimetallic corrosion. In this case, it would be preferable to braze or weld copper contacts to the aluminum tab portion 28 to avoid this bimetallic lap contact. It will be understood, however, that this procedure is merely preferred and that direct interconnection between an aluminum tab portion 28 and a copper anode connector 16 would be possible.

Anode pan 20 is originally a flat sheet but is stamped to form a recessed anode chamber 34 and a plurality of inwardly extending ribs 36 having peaks 38 thereon. A foraminous anode member 40 is spot welded to anode pan 20 at peaks 38. Foraminous anode 40 is of a type which is generally well known in the art comprising a valve metal substrate having an electrocatalytic coating applied thereto of precious metals and/or oxides thereof, transition metal oxides or mixtures of any of these materials. Anode member 40 is generally planar in form and may be constructed of any foraminous material such as expanded metal mesh or wire screening.

Cathode pan 22 comprises an inner layer 42 of a catholyte resistant material such as iron, steel, stainless steel or other similar alloy material. Outer layer 44 of cathode pan 22 is of a conductive metal such as aluminum or copper and is, preferably, the same outer layer material as outer layer 26 of anode pan 20 although it will be understood that it is not necessary that a common material be used for outer layers 26 and 44 of anode and cathode pans 20 and 22, respectively. Cathode pan 22 is identical in form to anode pan 20 in every way. Thus, a tab portion 46 extends beyond the pan itself for connection to cathode connectors 18 by fastening means such as bolt 48 and nut 50 in a manner which is functionally identical to tab portion 28 of anode pan 20.

As with anode pan 20, cathode pan 22 has a stamped, recessed cathode chamber 52 and a plurality of inwardly extending rib portions 54 having peaks 56 thereon. A foraminous cathode member 58 is attached as by spot welding at peaks 56 of rib members 54 in a manner similar to anode member 40. Foraminous cathode member 58 is constructed of a planar foraminous material such as wire mesh, expanded metal or perforated plate and may be of any catholyte resistant material but is, preferably, steel or stainless steel. Additionally, foraminous cathode 58 may have a coating thereon of a material which lowers the hydrogen discharge overpotential such as an alloy of nickel and a leachable metal such as aluminum or zinc applied thereto to create an increased surface area. It should be noted that in the forming and assembly of both anode pan 20 and cathode pan 22, no manual operation is necessary since the pans 20 and 22 may be formed on automatic stamping machines, and the welding of anode member 40 and cathode member 58 may be effected by automatic welding equipment. All this lends uniformity and simplicity to the manufacturing process and cost reduction to the resultant product.

In the assembly of complete monopolar cells 10, an ion exchange membrane 60 having a gasket member 62 surrounding the outside edge portions thereof is sandwiched between an anode pan 20 and a cathode pan 22 as shown in the figures. Each anode and cathode pan incorporates a peripheral flange portion 61, 63, respectively, which contacts the gasket 62 of membrane 60. In a manner common in the art, fastening means such as a plurality of bolts 64 and nuts 66 are passed through the flange portions 61, 63 of both anode and cathode pans, respectively, and the intermediate gasket 62. As is well known in the art, some type of electrical insulating is necessarily provided around the fastening means so that there is no shorting of the anode to the cathode at the fastening means. When completely assembled, anode chamber 34 faces cathode chamber 52 having membrane 60 acting as the divider wall separating the two, defining each. Anode member 40 is substantially parallel to and closely spaced from membrane 60 as is cathode member 58.

When aluminum is utilized as the conductive portion of the laminate, it is preferable, but not necessary, to employ a substantially nonoxidizing outer coating on the exterior surface of the pan structures. Coating materials may include plastics, heat-resistant paints, nonoxidizing salves or the like. Copper outer layers may be similarly protected, but such protection is not as critical as with aluminum.

At least one port is provided in each anode and cathode pan 20, 22 for admitting reactants and removing products from the anode and cathode chambers 34, 52. In the embodiment shown in FIG. 1, adjacent monopolar cells 10 are situated so that an anode pan 20 of one cell 10 is adjacent to an anode pan of the adjacent cell. Similarly, the cathode pan 22 is adjacent the cathode pan of an adjacent monopolar cell. With this arrangement, a common header such as Y-form tubing 70 may be utilized to serve adjacent ports 68 in two adjacent cathode pans or anode pans depending on positioning. In practice, it is common to utilize at least one inlet port and at least one outlet port for reactants and products, respectively, in the assembly of a cell, although it will be understood that such an arrangement is not necessary. Furthermore, the facing cathode pans and anode pans of adjacent cells offer only the convenience of utilizing a single header system to serve two adjacent cells, thus, reducing the complications of piping and again, such economies are only desirable and not necessary.

While the invention has been described in the more limited aspects of a preferred embodiment thereof, other embodiments have been suggested, and deviations and modifications from those embodiments will occur to those skilled in the art upon the reading and understanding of the foregoing specification. It is intended that all such embodiments be included within the scope of the invention as defined only by the appended claims.

What is claimed is:

1. A monopolar membrane-type electrolytic cell for electrolytic processes, the cell comprising:

an anode chamber defined by said membrane, a generally planar foraminous titanium anode and a stamped metal laminate anode pan having an interior layer of titanium bonded throughout its extent to a thicker outer layer of aluminum;

a cathode chamber defined by said membrane, a generally planar foraminous steel cathode and a stamped metal laminate cathode pan of identical form to said anode pan and having an interior layer of steel bonded throughout its extent to a thicker outer layer of aluminum;

said cell further characterized in that each said anode and cathode pan affords a recessed chamber with a plurality of inwardly extending rib portions, each said rib portion being welded to said respective anode and cathode; and said anode and cathode are substantially parallel to and closely spaced from said membrane.

* * * * *